US007910867B1

(12) United States Patent
Edwards et al.

(10) Patent No.: US 7,910,867 B1
(45) Date of Patent: Mar. 22, 2011

(54) ARCHITECTURE FOR A LAUNCH CONTROLLER

(75) Inventors: Ralph W. Edwards, Phoenix, MD (US); George H. Goetz, Joppa, MD (US); Jennifer L. Houston-Manchester, Baldwin, MD (US); Christine A. Ballard, Glen Burnie, MD (US); Benjamin D. Skurdal, Bel Air, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 1238 days.

(21) Appl. No.: 11/468,728

(22) Filed: Aug. 30, 2006

Related U.S. Application Data

(60) Provisional application No. 60/778,764, filed on Mar. 3, 2006.

(51) Int. Cl.

| | |
|---|---|
| ***G06F 19/00*** | (2006.01) |
| ***F41G 9/00*** | (2006.01) |
| *F42B 15/00* | (2006.01) |
| *G06G 7/80* | (2006.01) |

(52) U.S. Cl. ..... 244/3.1; 89/1.11; 89/1.1; 89/1.8; 89/1.815; 89/1.816; 235/400

(58) Field of Classification Search ..... 244/3.1–3.3, 244/171.6; 89/1.11, 37.01, 41.01, 41.19, 89/41.22, 1.809, 1.81, 1.813, 1.814, 1.815, 89/1.8–1.82, 1.1; 701/1, 3, 29–35; 703/6–8; 102/283, 285, 288; 235/400–418
See application file for complete search history.

(56) References Cited

U.S. PATENT DOCUMENTS

| | | | | |
|---|---|---|---|---|
| 2,992,423 | A * | 7/1961 | Floyd et al. | 244/3.15 |
| 3,535,683 | A * | 10/1970 | Moser et al. | 701/29 |
| 3,598,344 | A * | 8/1971 | Walters et al. | 244/3.11 |
| 3,680,749 | A * | 8/1972 | Davis | 244/3.14 |
| 3,735,668 | A * | 5/1973 | Langlois et al. | 89/1.814 |
| 5,036,465 | A | 7/1991 | Ackerman, Jr. et al. | |
| 5,036,466 | A | 7/1991 | Fitzgerald et al. | |
| 5,080,300 | A * | 1/1992 | Stubbs et al. | 244/3.11 |
| 5,091,847 | A | 2/1992 | Herbermann | |
| 5,096,139 | A | 3/1992 | Feld et al. | |
| 5,118,050 | A * | 6/1992 | Arnold et al. | 244/3.14 |
| 5,129,063 | A | 7/1992 | Sainola et al. | |
| 5,208,422 | A * | 5/1993 | Moody | 89/1.809 |
| 5,452,640 | A * | 9/1995 | Bovee et al. | 89/1.815 |

(Continued)

FOREIGN PATENT DOCUMENTS

EP 431804 A2 6/1991

(Continued)

OTHER PUBLICATIONS

"What's Middleware"; Sacha Krakowiak; copyrighted in the year 2003; posted on the Internet at objectweb.org.*

*Primary Examiner* — Bernarr E Gregory
(74) *Attorney, Agent, or Firm* — DeMont & Breyer, LLC

(57) ABSTRACT

A scalable and distributable software architecture for use in conjunction with various different weapons control system and launch systems is disclosed. The architecture discards the proprietary and non-open protocols and services that characterize in favor of open source adaptive and middleware components. In the illustrative embodiment of the invention, the inventive architecture is implemented as a Launch Control Module that separates different layers of responsibility within a launch controller (e.g., LCU) and exposes its variation points.

13 Claims, 8 Drawing Sheets

U.S. PATENT DOCUMENTS

| | | | | |
|---|---|---|---|---|
| 5,742,609 | A * | 4/1998 | Kondrak et al. | 244/3.16 |
| 5,992,292 | A * | 11/1999 | Ennenga | 89/41.22 |
| 6,152,011 | A * | 11/2000 | Ivy et al. | 89/1.814 |
| 6,610,971 | B1 | 8/2003 | Crabtree | |
| 6,755,372 | B2 * | 6/2004 | Menzel et al. | 244/3.15 |
| 6,839,662 | B2 | 1/2005 | Schnatterly et al. | |
| 7,228,261 | B2 * | 6/2007 | Leonard et al. | 703/8 |
| 2003/0111574 | A1 * | 6/2003 | Menzel et al. | 244/3.1 |
| 2004/0243378 | A1 | 12/2004 | Schnatterly et al. | |
| 2005/0081733 | A1 * | 4/2005 | Leonard et al. | 102/288 |

FOREIGN PATENT DOCUMENTS

| | | | |
|---|---|---|---|
| EP | 471225 | A2 | 2/2002 |
| GB | 2136097 | A | 9/1984 |
| GB | 2225851 | A | 6/1990 |

* cited by examiner

Figure 1
Prior
Art
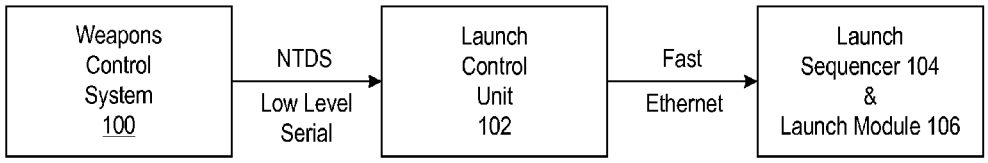
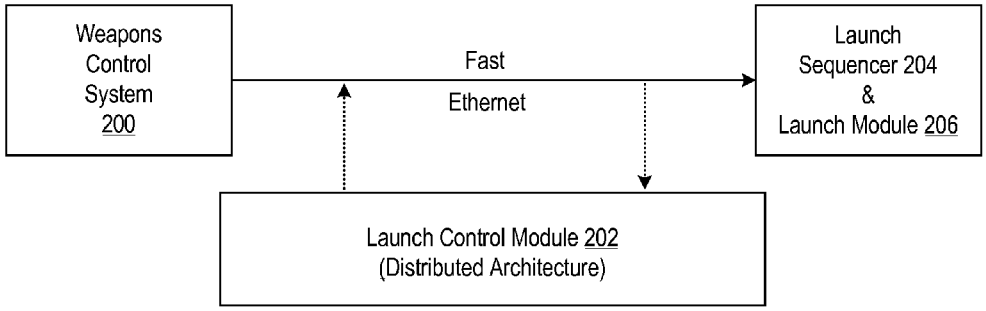
Figure 2

ARCHITECTURE FOR A LAUNCH CONTROLLER

STATEMENT OF RELATED CASES

This case claims priority of U.S. Provisional Patent Application Ser. No. 60/778,764, which was filed on Mar. 3, 2006 and is incorporated by reference herein in its entirety.

FIELD OF THE INVENTION

The present invention relates generally to launch systems, and more particularly to an architecture for such systems.

BACKGROUND OF THE INVENTION

The Mk 41 Vertical Launching System (VLS) is a canister launching system that provides a rapid-fire launch capability against hostiles. The US Navy currently deploys MK 41 VLS on AEGIS-equipped Ticonderoga-class cruisers and Spruance- and Arleigh Burke-class destroyers, and plans to use it on next generation of surface ships. Additionally, MK 41 VLS is the choice of eight other international navies, including Canada, Japan, Germany, Turkey, Spain, Netherlands, Australia and New Zealand.

The basic element of the MK 41 VLS is an eight-cell launcher module. Each module is a complete, standalone dual-redundant launcher. Each module includes a launch control system, gas management system, missile canisters, ballistic deck & hatches with deluge and sprinklers, and walkways. Electronic equipment mounted on the 8-Cell Module monitors the stored missile canisters and the module components and assists in launching the missiles. Modules can be combined to form launchers tailored in size to meet individual combatant mission requirements. For example, The MK 41 VLS is currently deployed at sea in 13 different configurations, ranging from a single module with eight cells to a system having 16 modules with 128 cells.

Three components are required for firing a missile using the MK 41 VLS: a Weapon Control System (WCS), a Launch Control Unit (LCU), and a Launch Sequencer (LS). This architecture is depicted in FIG. 1 and described below.

Weapon Control System 100 is the man-machine interface for the MK 41 VLS weapons system.

Launch Sequencer 104, which is a part of the eight-cell launcher module, is the communication link between the upstream fire control systems and the missile itself.

Launch control unit 102, which is part of the eight-cell launcher module, maintains simultaneous interfaces with the various weapon control systems to provide simultaneous multi-mode launch coordination and reports inventory and launcher status. During normal operations, each Launch Control Unit 102 controls half of Launch Sequencers 104 in the launcher module. But if one of Launch Control Units 102 is offline, the other assumes control of all Launch Sequencers 104 in the launcher.

Launch Control Unit 102 contains a software component called the "Launch Control Computer Programs" ("LCCP"). This software component supports communication with Weapons Control System 100 over two NTDS serial communication lines, one for each direction. The LCCP support two-way communications with Launch Sequencer 104 over a redundant Ethernet LAN.

When a launch order is given, Weapons Control System 100 sends a signal to one of two parallel Launch Control Units 102 (only one of which is depicted) in each eight-cell launcher module. The Launch Control Unit then issues pre-launch and launch commands for the selected missile. Launch Sequencer 104 responds to the commands (issued by Launch Control Unit 102) by preparing the eight-cell missile module and missiles for launch and then launching the selected missile.

The MK-41 VLS has been in production since 1982 and is continually upgraded to incorporate new technology. Yet, in the MK-41 VLS, as in most launch systems, there is a dependency or fixed operational relationship between Weapons Control System 100 and Launcher Sequencer 104. This dependency arises from the use of proprietary and non-open protocols and services, as provided by Launch Control Unit 102.

As a consequence of the fixed operational relationship between the Weapons Control System and the Launch Sequencer, the architecture of the launch system is not flexible. That is, it is not scaleable for single cell launchers or other variations. It will support only one type of launch system (e.g., the MK41 VLS, etc.) and is platform dependent (i.e., operating system and processor). This limits the ability to incorporate new technologies into the MK-41 VLS and, to the extent that such integration is even possible, substantially complicates the integration process.

What is needed, therefore, is launching-system architecture that has a flexible framework that enables it to adapt to different launch systems, weapon control systems, and the like.

SUMMARY OF THE INVENTION

The present invention provides a scalable and distributable architecture for use in conjunction with various different weapons control systems and launch systems. The architecture eliminates the need, for example, for the Launch Control Unit in the MK-41 VLS.

The inventive architecture, which is software-based, discards the proprietary and non-open protocols and services that characterize the typical Launch Control Unit and replaces them with open source adaptive and middleware components. The inventive architecture is structured to expose potential points of variation. That is, the architecture is structured to avoid paths (i.e., hardware or software solutions) that, once implemented, dictate downstream or upstream systems and components.

In the illustrative embodiment of the invention, the inventive architecture is implemented as a Launch Control Module that separates different layers of responsibility within a prior-art launch control unit (e.g., launch control unit 102, see FIG. 1) and exposes its variation points.

In the illustrative embodiment of the invention, the layers of responsibility are separated by defining three "layers" within the Launch Control Module, including:

1) Launch-control software components (or "Launch Controller");
2) Sub-launch (or module) control software components (or "Module Controller");
3) Cell-control software components (or "Cell Controller").

The Launch Controller manages a logical grouping of weapon systems or launch sequencers (see, FIG. 1 and the accompanying description). The Launch Controller further acts as the focal point for redundancy in a fault tolerant architecture/application, as required (see, e.g. FIG. 7C).

The Module Controller manages multiple groupings of Cell Controllers as well as their interdependent hardware components. The Module Controller is also responsible for rules regarding safety and other issues related to the Cell Controllers.

The Cell Controller oversees missile-specific sequence control and interface with the launch hardware. Cell safety is managed at this layer as well. Types of Cell Controllers are configured as a function of physical missile types and their number in the system.

In some embodiments, the Launch Control Module is not distributed; it is hosted in a single hardware device (e.g., processor, etc.). For example, in some embodiments, the Launch Control Module is hosted by a single processor within the launch sequencer hardware. In some other embodiments, in particular those in which fault tolerance is a concern, it is desirable to provide a replica of the Launch Control Module on a second processor. The replica can be hosted by another processor within the launch sequencer hardware or on any hardware platform that is accessible to the weapons-system network. This can be done because the Launch Control Module disclosed herein is platform independent.

Platform independence is provided through the use of commercial off-the-shelf open-source adaptive and distribution middleware that provides services for platform independence and relocateability. A proxy pattern is employed to support independent interfaces. New and legacy interfaces, protocols, and communications schemes are handled at this level. A data distribution service model is used to communicate weapon availability to networked clients and redundant Launch Controllers and Module Controllers.

In some other embodiments, the Launch Control Module is distributed. In these embodiments, one or more of the "components" (e.g., the layers, or portions of the layers, etc.) of the Launch Control Module are deployed on more than one hardware device. Distribution of functionality is desirable for fault tolerance and in applications in which a particular component of the Launch Control Module is more closely associated with another subsystem (e.g., the WCS, etc.).

In addition to the three layers of the Launch Control Module, a Data Store component is defined. The Data Store supports the data distribution service model for remote monitoring and to support fault tolerance. Furthermore, the Data Store maintains configuration, mode, and availability/status information concerning the launching system.

The Launch Control Module includes one or more of the following capabilities, including the ability to:

- interface with multiple weapon control systems;
- control a hierarchical organization of Module Controllers and Cell Controllers;
- support reconfigurability of Module Controllers and Cell Controllers;
- support remote monitoring of weapon systems and inventory;
- support multiple and heterogeneous launching systems;
- support new and multiple weapon systems integration;
- support network distribution of components to promote survivability and mission success; and
- support open architecture criteria to promote platform independence and application distribution.

As a consequence of its flexible and distributable nature, the architecture described herein solves a number of legacy problems that are associated with launch systems, such as operating system and network dependencies, the tight coupling of software components, and the high costs of adding new launcher capabilities. The flexibility provided by the inventive architecture enables a launch system to accept new capabilities without impacting existing behavior and performance requirements.

BRIEF DESCRIPTION OF THE DRAWINGS

FIG. 1 depicts the use of the Launch Control Unit between a Weapon Control System and Launch Sequencer and Launcher Module, as in the Prior Art.

FIG. 2 depicts the illustrative embodiment of the present invention wherein the Launch Control Unit hardware is replaced by a Launch Control Module with a distributed architecture. The various software elements of the Launch Control Module can reside literally anywhere in the ship's computing environment.

FIG. 5 emphasizes the dependencies between various components.

FIG. 7A depicts the scalability of the Launch Control Module and FIG. 7B depicts fault tolerance.

DETAILED DESCRIPTION

Figure 3:
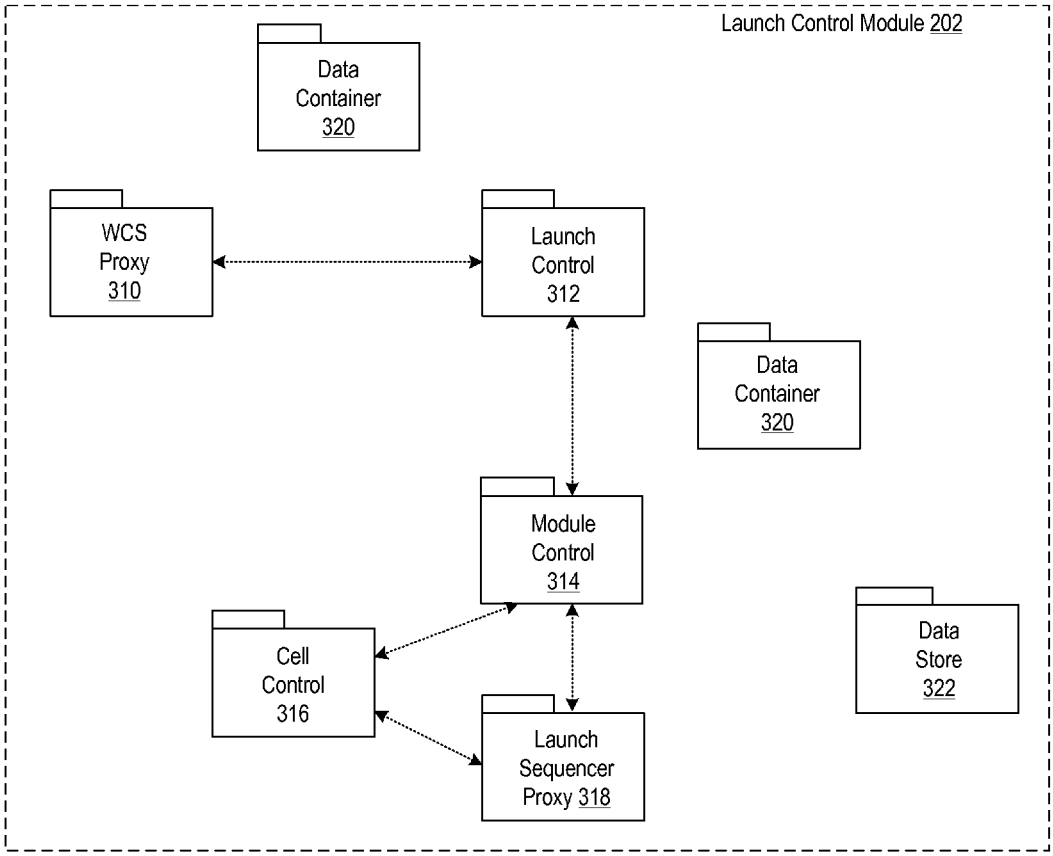
FIG. 3 depicts a top-level class diagram of a Launch Control Module in accordance with the illustrative embodiment of the present invention. The class diagram depicts the relationships between the various levels or layers of responsibility within the Launch Control Module.

The following terms are defined for use in this Specification, including the appended claims:

Proxy: In the context of terms such as "Launch Sequencer Proxy" and "Weapons Control System proxy, the word "proxy" signifies a boundary component that provides an interface to an external system. The proxy encapsulates the physical interface, protocols and some business rules for that specific interface.

Proxy pattern: In computer programming, a proxy pattern is a software design pattern. A proxy, in its most general form, is a class functioning as an interface to another thing. The other thing could be anything, a network connection, a large object in memory, a file, or other resource that is expensive or impossible to duplicate. A well-known example of the proxy pattern is a reference counting pointer object, also known as an auto pointer.

The proxy pattern can be used in situations where multiple copies of a complex object must exist. In order to reduce the application's memory footprint in such situations, one instance of the complex object is created, and multiple proxy objects are created, all of which contain a reference to the single original complex object. Any operations performed on the proxies are forwarded to the original object. Once all instances of the proxy are out of scope, the complex object's memory may be de-allocated. A proxy pattern is sometimes referred to as a "shortcut."

Types of Proxy patterns include, for example: remote proxy, virtual proxy, copy-on-write proxy, protection (access) proxy, cache proxy, firewall proxy, synchronization proxy, and a smart reference proxy.

Data Container: A data container is a convenience class for grouping data fields that belong together. The container classes provide common I/O for all objects stored in them and allow a large collection of objects to be passed around (e.g., between different software components).

Middleware: Middleware is computer software that connects software components or applications. It is used most often to support complex, distributed applications. It includes web servers, application servers, content management systems, and similar tools that support application development and delivery. Middleware is especially integral to modern information based on XML, SOAP, Web services, and service-oriented architecture. Middleware has been defined as the software layer that lies between the operating system and the applications on each side of a distributed computing system.

Remote Service Invocation: This term originates from the client-service paradigm supported by the CORBA specification. It refers to the ability of a local software component to make a procedure call. The component that is called can be hosted locally or on a remote node. The intent is for the client application to be unaware of the location of this service providing component. There must be a system service that provides the communication mechanism to cause the right service on the right node to be called, or invoked.

CORBA: CORBA is the acronym for Common Object Request Broker Architecture, which is an open, vendor-independent architecture and infrastructure that computer applications use to work together over networks. CORBA is available from Object Management Group (OMG), which is an international, open membership, not-for-profit computer industry consortium. Using the standard protocol HOP, a CORBA-based program from any vendor, on almost any computer, operating system, programming language, and network, can interoperate with a CORBA-based program from the same or another vendor, on almost any other computer, operating system, programming language, and network.

Data Distribution Service: DDS is networking middleware that simplifies complex network programming. It implements a publish/subscribe model for sending and receiving data, events, and commands among nodes. Nodes that are producing information (publishers) create "topics" (e.g., temperature, location, pressure) and publish "samples." DDS takes care of delivering the sample to all subscribers that declare an interest in that topic.

DDS handles all the transfer chores: message addressing, data marshaling and de-marshalling (so subscribers can be on different platforms than the publisher), delivery, flow control, retries, etc. Any node can be a publisher, subscriber, or both simultaneously.

The DDS publish-subscribe model virtually eliminates complex network programming for distributed applications.

DDS supports mechanisms that go beyond the basic publish-subscribe model. The key benefit is that applications that use DDS for their communications are entirely decoupled. The applications never need information about the other participating applications, including their existence or locations. DDS automatically handles all aspects of message delivery, without requiring any intervention from the user applications.

This is made possible by the fact that DDS allows the user to specify Quality of Service (QoS) parameters as a way to configure automatic-discovery mechanisms and specify the behavior used when sending and receiving messages. The mechanisms are configured up-front and require no further effort on the user's part. By exchanging messages in a completely anonymous manner, DDS greatly simplifies distributed application design and encourages modular, well-structured programs.

FIG. 2 depicts the illustrative embodiment of the present invention wherein the Launch Control Unit (hardware) of the prior art (e.g., see FIG. 1: Launch Control Unit 102) is replaced by Launch Control Module 202 with a distributed architecture. The Launch Control Module supports two-way communications with both Weapons Control System 200 and Launch Sequencer 204. Launch Control Module 202 is hosted, for example, on an interconnected Ethernet LAN. The various software components that compose Launch Control Module 202 can reside literally anywhere in the ship's computing environment, as long as they are accessible to the LAN. For example, in some embodiments, some of the software components of Launch Control Module 202 are hosted by Weapons Control System 200.

FIG. 3 depicts a top level class diagram of Launch Control Module 202 in accordance with the illustrative embodiment of the present invention. The salient elements of Launch Control Module 202 include: Weapons Control System Proxy 310, Launch Control software components (or "Launch Controller") 312, Module Control software components (or "Module Controller") 314, Cell Control software components (or "Cell Controller") 316, Launch Sequencer Proxy 318, Data Container 320, and Data Store 322, interrelated as shown.

Launch Controller 312 manages a logical grouping of weapon systems or launch sequencers. The Launch Controller further acts as the focal point for redundancy in a fault tolerant architecture/application, as required (see, e.g. FIG. 7C).

Module Controller 314 manages multiple groupings of Cell Controllers 316 as well as their interdependent hardware components. Module Controller 314 is also responsible for rules regarding safety and other issues related to the Cell Controllers 316.

Cell Controller 316 oversees missile-specific sequence control and interface with the launch hardware. Cell safety is managed at this layer as well. Various types of Cell Controllers 316 are configured as a function of physical missile types and number in the system.

Data Containers 320 are objects of information that are exchanged between two other components on the diagram (e.g., between Weapons Control System Proxy 310 and Launch Controller 312, etc.). In fact, in some embodiments, all communications within the inventive architecture use data containers. In some other embodiments, Data Containers are replaced with method calls using an RPC or client-server mechanism. The flow of data in the Data Containers is shown in the directed lines.

Data Store 322 supports the Distribution Middleware feature of a Data Distribution Service (DDS). In some alternative embodiments, data store 322 is replaced with a commercial off-the-shelf or Object Management Group (OMG) compliant service. No lines of communication are depicted between Data Store 322 and other components for the sake of clarity. In fact, Data Store 322 receives registration requests (subscriptions) and publications from many of the components of Launch Control Module 202 (e.g., Launch Controller 312, Module Controller 314, Cell Controller 316, etc.), as needed. Data Store 322 then sends instances of the published data to all subscribers. This is the Data Distribution Model.

Weapon Control System Proxy 310 supports two-way communications between Launch Control Module 202 and Weapon Control System 200. Launch Sequencer Proxy 318 performs the same role for the communications with Launch Sequencer 204.

Figure 4:
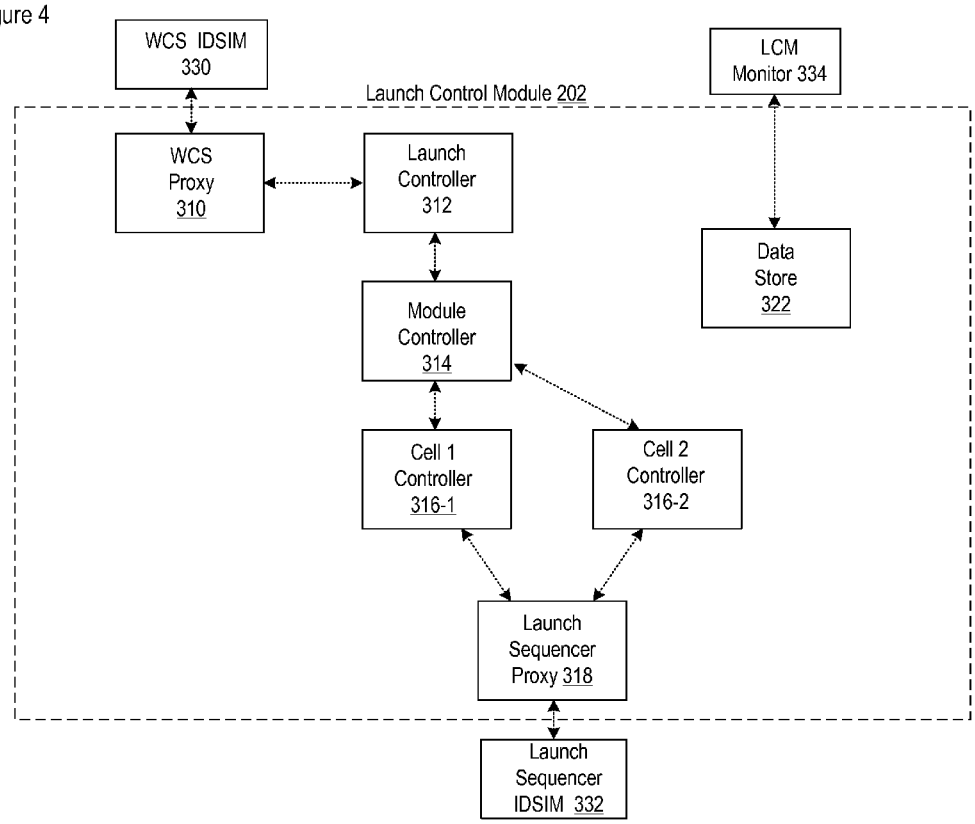
FIG. 4 depicts a deployment diagram of the Launch Control Module of FIG. 3. The deployment diagram shows the data flow between components of the Launch Control Module.

FIG. 4 is similar to FIG. 3 but emphasizes the relationship and data flow between components in Launch Control Module 202 and external systems. Three distinct interfaces are depicted, two of which are based on documented interface design specifications.

The first is between Weapon Control System IDSIM 330 and Weapon Control System Proxy 310, which in some embodiments communicate over an Ethernet interface. The second is between Launch Sequence Proxy 318 and Launch Sequencer IDSIM 332. It is notable that "IDSIM" is a simulation of those components indicated and can be substituted for test purposes. The third interface shows the relationship between Launch Control Module Monitor 334 and Data Store 322. The Launch Control Module Monitor uses the Data Distribution Service to subscribe and receive data published by other components within Launch Control Module 202 (e.g., Launch Controller 312, Module Controller 314, Cell Controllers 316-1, 316-2, etc.).

FIG. 4 depicts two instances of the Cell Controller; that is, Cell 1 Controller 316-1 and Cell 2 Controller 316-2. This Figure illustrates the relationship between multiple Cell Controllers and other components in Launch Control Module 202 (e.g., Module Controller 314 and Launch Sequencer Proxy 318). For clarity, the relationships/communication between Data Store 322 and other components of Launch Control Module 202 are not shown.

Figure 5:
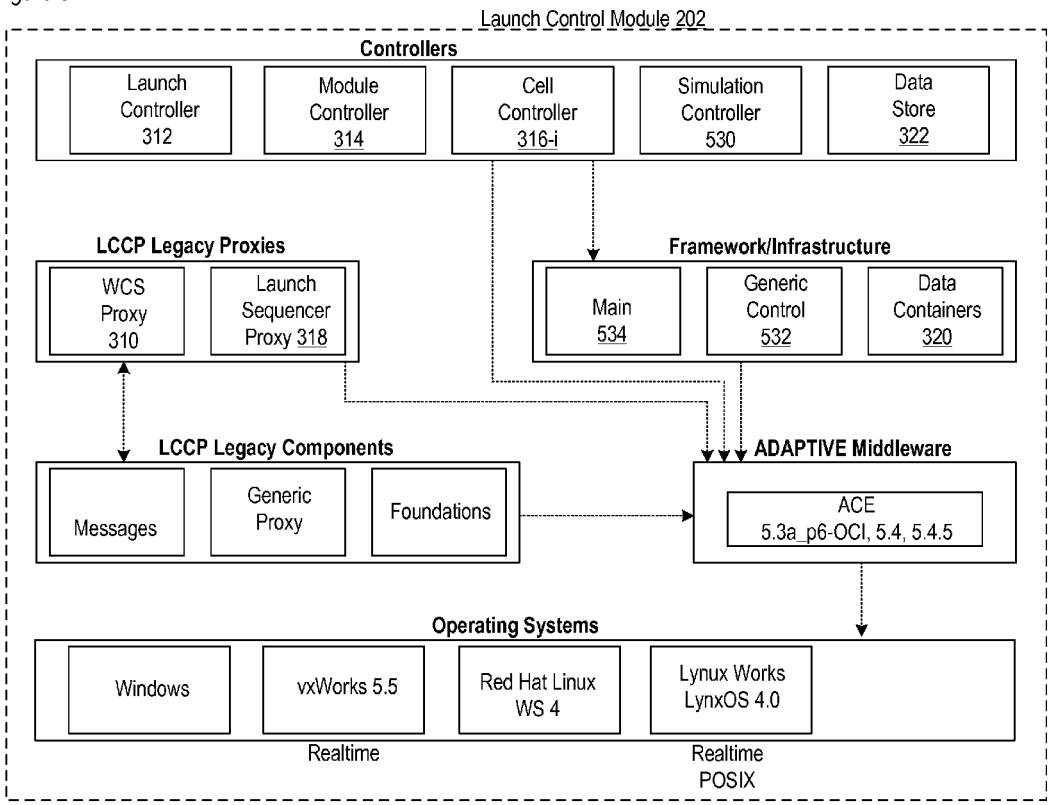
FIG. 5 depicts further details of the architecture of the Launch Control Module of FIGS. 3 and 4.

FIG. 5 depicts an embodiment of the salient components of Launch Control Module 202 and additional supporting components to show interdependencies. FIG. 5 depicts the various components of Launch Control Module 212 as belonging to specific "layers." Launch Control Module 202 does not interact directly with the operating system services or communications services directly, but, rather, uses an Adaptive Middleware.

It is notable that the dependency relationship between some of the legacy components in FIG. 5 flows in two directions. It is preferable that the dependency relationships flow in one direction.

Regarding items that have not previously been described, simulation controller 530 provides a simulation of the cell control functionality at the sub-launch level. This capability is used for upper layer validation and training. This component, like the other elements, can be allocated to any network processor. Simulation controller 530 is invoked by the Launch Control 312 when commanded by Weapon Control System 200. Simulation controller 530 is an optional component; in some embodiments it is included and in some other embodiments it is not. This could be performed statically or with dynamic composition.

In the "Framework/Infrastructure" layer, software package entitled main 534 provides a common service that is required on most operating systems. Variation from one operating system to another for initiation of the application is performed via this package.

Generic Control 532 is a package of software components in the "Framework/Infrastructure" layer. This package provides a common set of services required by all controllers in the architecture. It provides the pattern for implementing a controller and is the point of variation required when underlying operating system services require a change. This package isolates those changes from the application component in the next higher layer.

The layer called "LCCP Legacy Components" shows one embodiment of the architecture wherein some components are reused from the existing Launch Control Computer Program (LCCP) in the prior art. In some embodiments, this is a transitory path wherein message validation occurs.

Figure 6:
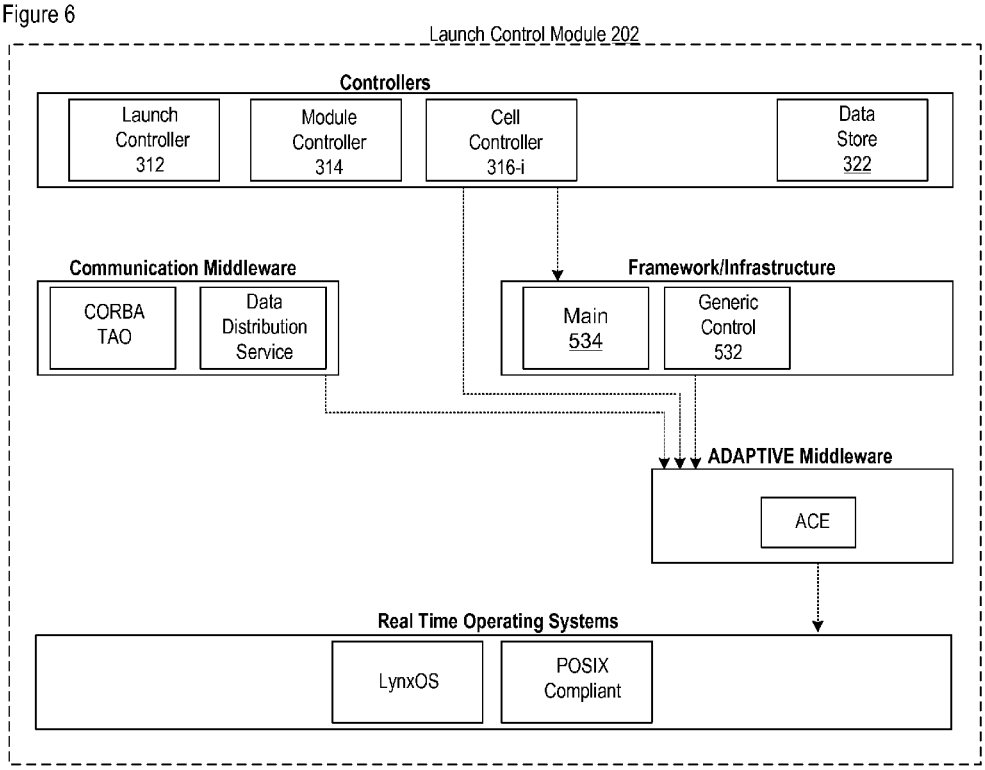
FIG. 6 depicts the flexibility of the Launch Control Module, showing, in particular, the incorporation of commercial off-the-shelf components within the Launch Control Module of FIG. 3.

FIG. 6 depicts a preferred embodiment of the architecture of Launch Control Module 202 in which all dependency relationships flow in one direction. In this embodiment, Communications Middleware, also know as Distribution Middleware, has replaced the problematic legacy proxies and legacy components. In some embodiments that utilize Distribution Middleware, data containers 320 (as are present in FIG. 5) are not used.

Figure 7A:
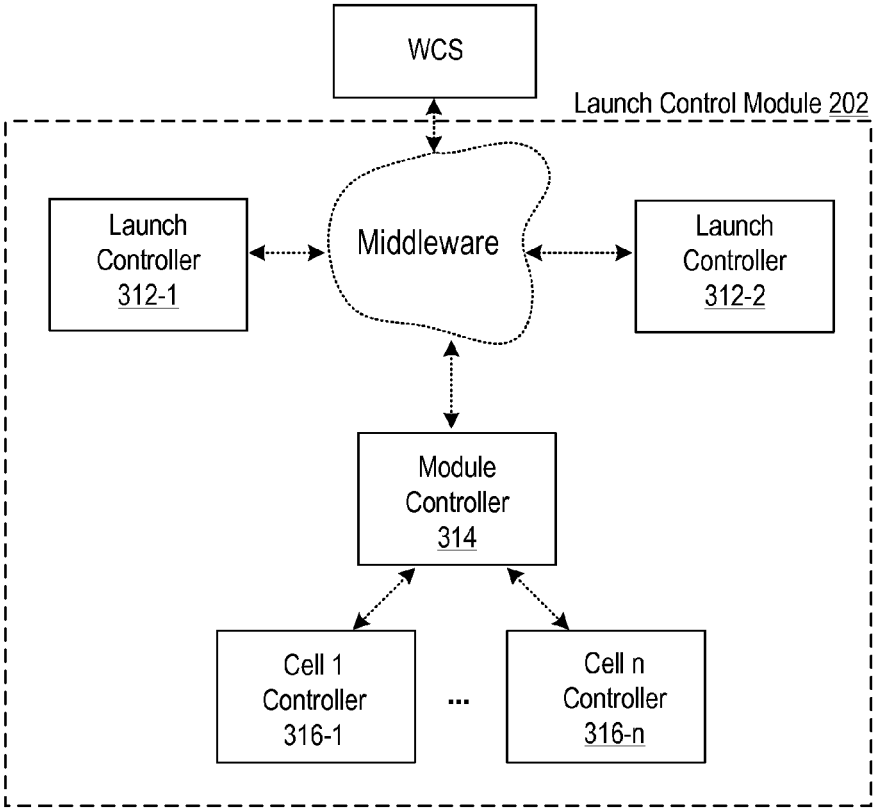
FIGS. 7A-7B depict aspects of the flexibility of the open architecture approach of the present invention.

FIG. 7A depicts a fault-tolerant embodiment of the Launch Control Module 202 wherein Launch Controller 312 is replicated (i.e., Launch Controllers 312-1 and 312-2). A Fault Tolerant Distribution Middleware is used to manage the replicants and the fault notification and fail-over mechanisms.

Figure 7B:
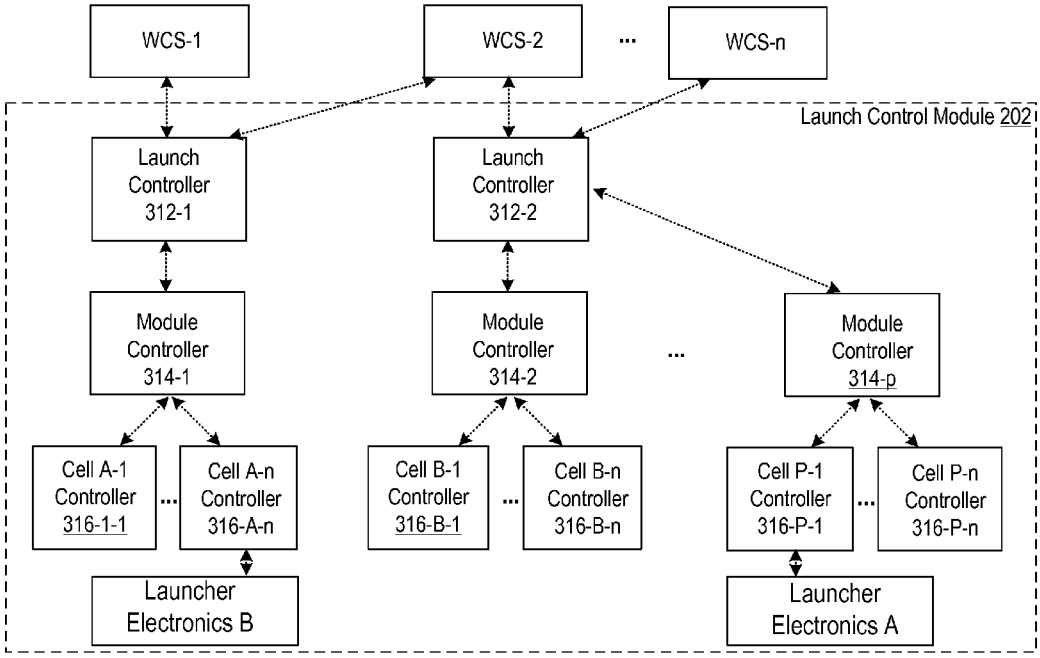

FIG. 7B depicts an embodiment of Launch Control Module 202 that highlights its scaleable and modular nature. In particular, in the embodiment that is depicted in FIG. 7B, Launch Control Module 202 is supporting multiple Weapons Control Systems (i.e., WCS-1, WCS-2, WCS-n).

Key features of the embodiment of Launch Control Module 202 that is depicted in FIG. 7B include:

- the ability of Launch Controller 312 to communicate with different Weapons Control Systems.
- Launch Controller (312-2) has been configured to support multiple Module Controllers 314 (i.e., 314-2, . . . , 314-*p*). In some embodiments, the multiple Module Controllers support different types of launching systems.

The Launcher Electronics that are depicted in FIG. 7B provide a low-level, time-critical control and weapon (or missile) interface for a specific weapon system.

Figure 8:
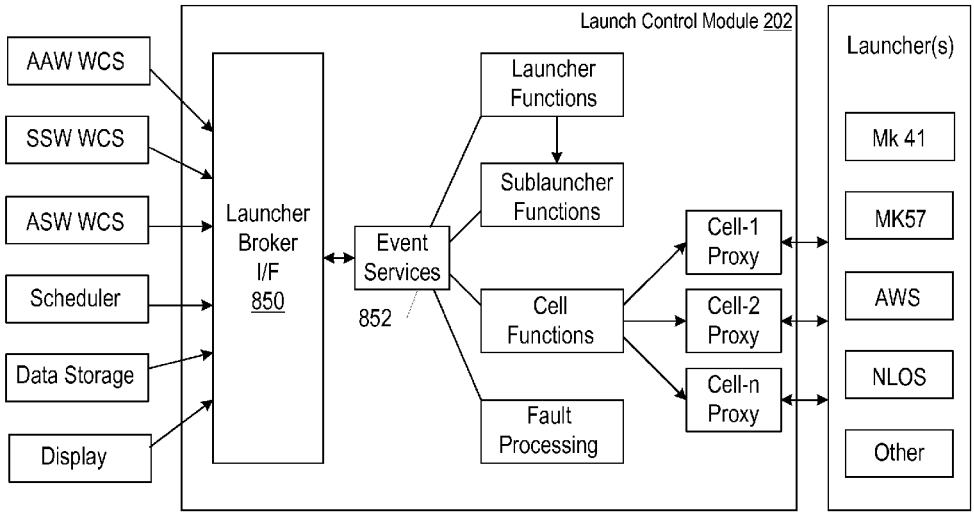
FIG. 8 depicts a further perspective of a Launch Control Module in accordance with the present invention, showing its compatibility with a "Launcher Broker" interface.

FIG. 8 depicts an alternative embodiment of Launch Control Module 202 wherein it is configured to support a variety of Weapon Control Systems as well as several different weapon systems and launch sequencers. This embodiment employs Launcher Broker Interface 850, which is used to decouple Launch Control Module 202 from clients using remote service invocations to support a common launcher interface. In other words, Launcher Broker Interface 850 provides a common interface so that different launching systems will "look" similar to the client, or user, of the system. This also provides transparency when the underlying system is modified or when new systems are added, since the common interface will remain the same.

Event Services 852 is a software package that provides for an exchange of information between two systems, typically upon a change in state or an "event." This is often used as a generic term, but actually originates from the OMG CORBA specification. In a more recent version of the OMG specification, which is based on the "publish-subscribed" paradigm, event services are replaced with the Data Distribution Service (DDS).

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

We claim:

1. An interface for interfacing a weapons control system with a launch sequencer comprising: at least one processor and a launch control module for providing launch coordination;

wherein said launch control module is software that is executed by said at least one processor;

wherein said launch control module includes:

(a) a first launch controller for managing a logical grouping of weapon systems or launch sequencers;

(b) a first cell controller for overseeing missile-specific sequence control and interfacing with launch hardware; and (c) a first sub-launch controller for managing at least one said cell; and wherein said launch control module is in communication with the weapons control system and the launch sequencer.

2. The interface of claim 1 wherein said launch control module is executed by a single processor.

3. The interface of claim 1 comprising:

a replica of said launch control module;

wherein said launch control module is a executed by a first processor; and wherein said launch control module replica is executed by a second processor.

4. The interface of claim 1 wherein said launch control module is distributed such that at least two of said launch controller, said cell controller, and said sub-launch controller are hosted on different hardware devices.

5. The interface of claim 1 wherein said launch control module further includes: (d) adaptive middleware.

6. The interface of claim 1 wherein dependency relationships within said launch control module flow in one direction.

7. The interface of claim 1 and further wherein said launch control module communicates with a second weapons control system.

8. The interface of claim 1 wherein at least one software component of said launch control module is hosted by said weapons control system.

9. The interface of claim 1 wherein said launch control module does not directly communicate with an operating system.

10. The interface of claim 1 wherein said launch control module comprises a second sub-launch controller, wherein said first sub-launch controller supports a first launch system and said second sub-launch controller supports a second launch system, and further wherein said first launch system and said second launch system are different from one another.

11. The interface of claim 1 wherein said launch control module further comprises a launcher-broker interface, wherein said launcher-broker interface serves as an interface between said first launch controller and said first weapons control system and further serves as an interface between said first launch controller and a second weapons control system.

12. An interface for interfacing a plurality of launch control systems with a plurality of launch sequencers_comprising:

at least one processor and a launch control module for providing launch coordination;

wherein said launch control module is software that is executed by said at least one processor;

wherein said launch control module is in communication with said plurality of weapons control systems and said plurality of launch sequencers;

wherein said launch control module comprises adaptive middleware; and wherein said launch control module has a layered structure including a launch controller layer, a sub-launch controller layer, and a cell controller layer, wherein said launch controller, sub-launch controller, and cell controller layers are segregated by responsibility to expose points of variation, thereby avoiding paths that dictate specific weapons control systems or launch sequencers.

13. The interface of claim 12 wherein:

(i) the launch controller layer is responsible for managing a logical grouping of weapon systems or launch sequencers;

(ii) the cell controller layer is responsible for overseeing missile-specific sequence control and interfacing with launch hardware; and (iii) the sub-launch controller layer is responsible for managing at least one said cell controller and interdependent hardware components thereof.

* * * * *